United States Patent [19]

Maier et al.

[11] 4,391,896

[45] Jul. 5, 1983

[54] MIXTURE OF NONDIFFUSIBLE REDOX DYE-RELEASERS FOR CURVE SHAPE CONTROL

[75] Inventors: Thomas O. Maier; Jack L. Richards, both of Rochester, N.Y.

[73] Assignee: Eastman Kodak Company, Rochester, N.Y.

[21] Appl. No.: 944,113

[22] Filed: Sep. 20, 1978

[51] Int. Cl.[3] ..... G03C 1/40; G03C 1/10; G03C 5/54

[52] U.S. Cl. ..... 430/223; 430/212; 430/236; 430/242; 430/390; 430/391; 430/505; 430/559

[58] Field of Search ..... 96/3, 29 D, 77, 99, 96/73; 430/223, 212, 505, 559, 236, 242, 390, 391

[56] References Cited

U.S. PATENT DOCUMENTS

| | | | |
|---|---|---|---|
| 3,230,085 | 1/1966 | Dershowitz | 430/225 |
| 3,516,831 | 6/1970 | Wolf et al. | 430/506 |
| 3,537,850 | 11/1970 | Simon | 430/222 |
| 3,585,028 | 6/1971 | Stephens | 430/223 |
| 3,620,747 | 11/1971 | Marchant et al. | 430/505 |
| 3,811,890 | 5/1974 | Ohta et al. | 430/505 |
| 3,933,494 | 1/1976 | Busatto et al. | 430/222 |
| 3,990,899 | 11/1976 | Shiba et al. | 430/506 |
| 4,076,529 | 2/1978 | Fleckenstein et al. | 430/223 |

OTHER PUBLICATIONS

"A Fundamentally . . . Photography", Hanson, *Photo Ice and Energy* vol. 20, No. 4, 8/1976, pp. 155–160.

*Primary Examiner*—Richard L. Schilling
*Attorney, Agent, or Firm*—Harold E. Cole

[57] ABSTRACT

Curve shape control, especially for lower scale contrast, of a photographic element is achieved by employing with the silver halide emulsion layer two nondiffusible redox dye-releasing compounds of different relative reactivities, the reactivity of the compound which is more reactive being at least 1.5 times the reactivity of the compound which is less reactive. Preferred compounds are ballasted sulfonamido compounds, each of which has a color-providing moiety attached thereto through a sulfonamido group which is alkali-cleavable upon oxidation. Preferred more reactive sulfonamido compounds have a N,N-disubstituted carbamoyl ballast group. The color-providing moieties can be (1) transferred imagewise to an image-receiving layer to provide a useful image, or (2) can be merely diffused out of the element to provide a retained image therein which can be treated to form a color transparency or a motion picture film.

39 Claims, No Drawings

MIXTURE OF NONDIFFUSIBLE REDOX DYE-RELEASERS FOR CURVE SHAPE CONTROL

This invention relates to photography, and more particularly to color diffusion transfer photography wherein a silver halide emulsion layer is employed which has associated therewith two nondiffusible redox dye-releasing compounds of different relative reactivities. Use of this invention provides a way to control curve shape, especially in lower scale contrast of the dye image formed from the dye moieties which are released as a function of development.

U.S. Pat. No. 4,076,529 of Fleckenstein et al, issued Feb. 28, 1978, describes various color image transfer elements which employ various nondiffusible sulfonamido compounds which are alkali-cleavable upon oxidation to release a diffusible color-providing moiety.

U.S. Pat. No. 4,135,929 of Fernandez et al, issued Jan. 23, 1979, also describes various nondiffusible sulfonamido compounds which are alkali-cleavable upon oxidation to release a diffusible color-providing moiety. These sulfonamido compounds contain a N,N-disubstituted carbamoyl ballast group which shows a high degree of efficiency with respect to the release of a color-providing moiety which, in turn, provides various improvements. These compounds are more reactive, i.e., produce more dye in a given amount of time, than those described in the Fleckenstein et al patent referred to above.

U.S. Pat. No. 3,811,890 describes a photographic element wherein at least one of the silver halide emulsion layers contains two couplers having different coupling activity rates. The two dyes which are formed have different maximum absorption wavelengths to produce a shifting of the absorption of the final color image.

While the sulfonamido compounds described in U.S. Pat. No. 4,076,529 referred to above have been shown to be useful, there are instances when it is desirable to change a given curve shape of the photographic film, i.e., change the shape of the conventional sensitometric curve of Density versus Log Exposure. For example, one might want to lower the contrast in the lower part of the sensitometric curve to a particular value in order to improve the recording of detail in the highlight area of the original scene. This, in turn, could provide improved sensitometric properties, such as improved color reproduction and exposure latitude.

Use of our invention provides a tool for manipulation of various curve shapes of different dye-releasers to achieve a desired result for lower, as well as upper, scale contrast. Our invention comprises a photographic element comprising a support having thereon at least one photosensitive silver halide emulsion layer which has associated therewith two nondiffusible redox dye-releasing (RDR) compounds having different relative reactivities, the reactivity of the more reactive compound being at least 1.5 times the reactivity of the less reactive compound, i.e., the amount of dye released in a given period of time by the more reactive compound is at least 1.5 times that amount released by the other less reactive compound. This result was unexpected in that it was not possible to predict what would happen when the two compounds were mixed. For example, one skilled in the art might have thought that the more reactive compound might dominate the curve shape of the mixture, or that only a shift in speed would result.

Enabling a curve shape for a mixture of dye-releasers to be changed to a preselected result merely by changing the concentration of each dye-releaser employed is a convenient and highly desirable sensitometric tool.

Relative reactivities of nondiffusible RDR compounds, as described in our invention, can be determined in a number of ways. One such way for determining the relative reactivity of a negative-working RDR is the following test:

(1) A transparent film support is coated with a layer containing 100 mg of gelatin and 0.05 mmole of the RDR to be tested per square foot of support.

(2) Aqueous solutions of potassium ferricyanide and 4-hydroxymethyl-4-methyl-1-phenyl-3-pyrazolidone are rapidly mixed to form oxidized electron transfer agent $ETA_{ox}$.

(3) A constant solution of $ETA_{ox}$ in 0.5 N KOH is then maintained at the surface of the coated film support by applying to it a stream of the $ETA_{ox}$ solution using a continuous flow apparatus.

(4) The decomposed $ETA_{ox}$ and the dye which is released from the RDR are rapidly pumped from the surface of the film support while it is being spectrophotometrically measured as a function of time.

(5) From the data obtained from various RDR's, a more reactive RDR is so categorized by the greater amount of dye released in a given unit of time relative to a less reactive RDR.

In accordance with our invention, a more reactive RDR and a less reactive RDR will have the following relationship to represent the relative reactivity as measured by the above test:

$$\log (D_t/D_o)_M = k \log (D_t/D_o)_L$$

wherein:

M is a film support coated with a more reactive RDR;

L is a film support coated with a less reactive RDR;

$D_o$ is the initial transmission density measured at $\lambda_{max}$ of the coated film support before testing;

$D_t$ is the transmission density measured at $\lambda_{max}$ of the coated film support at a given period of time; and k is a value equal to or greater than 1.5.

Any combination of nondiffusible redox dye-releasers can be used in our invention, provided that they have the relative reactivity relationship described above. Such compounds are well known to those skilled in the art and are, generally speaking, compounds which will redox with oxidized developing agent or electron transfer agent to release a dye, such as by alkaline hydrolysis, or prevent the release of dye, such as by intramolecular nucleophilic displacement. Such nondiffusible RDR's can be positive-working compounds, as described in U.S. Pat. No. 3,980,479, British Pat. No. 1,464,104 and U.S. Pat. No. 4,139,379, issued Feb. 13, 1979. Such nondiffusible RDR's can also be negative-working compounds, as described in U.S. Pat. Nos. 3,728,113 of Becker et al; 3,725,062 of Anderson and Lum; 3,698,897 of Gompf and Lum; 3,628,952 of Puschel et al; 3,443,939 and 3,443,940 of Bloom et al; 4,053,312 of Fleckenstein; 4,076,529 of Fleckenstein et al; 4,055,428 of Koyama et al; German Pat. Nos. 2,505,248 and 2,729,820; Research Disclosure 15157, November, 1976; and Research Disclosure 15654, April, 1977.

In a preferred embodiment of our invention, the nondiffusible RDR's are ballasted sulfonamido compounds, each of which has a color-providing moiety attached thereto through a sulfonamido group which is alkali-cleavable upon oxidation. One such sulfonamido compound may have a different relative reactivity than another because the carrier (naphthol, pyridine, etc) is different, or because one compound may have different substituents than the other, or because the ballast moieties may be different. In a more prefered embodiment of our invention, the ballast group on the more reactive sulfonamido compound is a N,N-disubstituted carbamoyl group. The color-providing moiety which is released from each sulfonamido compound is substantially of the same hue. If the two color-providing moieties are different, but still substantially of the same hue, better dye stability of the final image can often be achieved.

In another preferred embodiment of our invention, the less-reactive compound described above has the following formula:

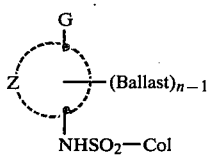

and the more-reactive compound described above has the following formula:

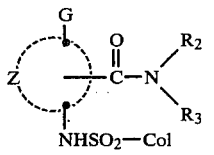

wherein:

(a) each Col is a dye or dye precursor moiety;

(b) each G is —OR or —NHR$_1$, wherein R is hydrogen or a hydrolyzable moiety, and R$_1$ is hydrogen, an alkyl group of 1 to 22 carbon atoms or a —SO$_2$-Col moiety;

(c) Ballast is an organic ballasting radical of such molecular size and configuration as to render said compound nondiffusible during development in an alkaline processing composition;

(d) n is a positive integer of 1 to 2, and is 2 when G is OR or when R$_1$ is hydrogen, an alkyl group of less than 8 carbon atoms, or —SO$_2$Col;

(e) R$_2$ and R$_3$ each represents an aliphatic, alicyclic or aromatic group, at least one of which or the combination thereof being of such size and configuration as to render said compound nondiffusible during development in an alkaline processing composition;

(f) each Z represents the atoms necessary to complete a one-, two- or three-ringed carbocyclic or heterocyclic group containing 5 to 7 nuclear atoms in each ring; and (g) each —NHSO$_2$-Col group being joined to a position on Z so as to be conjugated to G.

In a highly preferred embodiment of our invention, each of the nondiffusible compounds described above is a sulfonamidophenol, a sulfonamidonaphthol or a sulfonamidoaniline, and the silver halide emulsion is a direct-positive silver halide emulsion.

In another highly preferred embodiment of our invention, the less-reactive compound described above has the following formula:

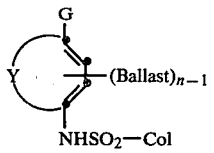

and the more-reactive compound described above has the following formula:

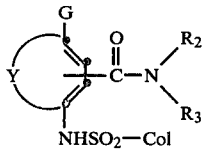

wherein:

Col, G, Ballast, n, R$_2$ and R$_3$ are defined as above; and each Y represents the atoms necessary to complete a benzene nucleus, a naphthalene nucleus or a 5- to 7-membered heterocyclic ring, such as pyrazolone, pyrimidine, pyridine, etc.

In the above formulas, particularly good results are obtained when:

(a) each G is OH;

(b) n is 2;

(c) each Y and Z is a naphthalene nucleus;

(d) R$_2$ and R$_3$ are each straight chain alkyl groups of 1 to 30 carbon atoms, with the proviso that the total number of carbon atoms is from about 8 to about 50; and (e) the carbamoyl ballast group in said more reactive compound is located ortho to G.

In the formulas listed above, R is preferably hydrogen, although it could be any hydrolyzable moiety well known to those skilled in the art, such as acetyl, mono-, di- or trichloroacetyl radicals, perfluoracyl, pyruvyl, alkoxyacyl, nitrobenzoyl, cyanobenzoyl, sulfonyl, sulfinyl, etc.

As described above, R$_1$ can be hydrogen, an alkyl group of 1 to 22 carbon atoms or a —SO$_2$Col moiety. Examples of alkyl groups, including substituted alkyl groups, useful for R$_1$ include methyl, ethyl, hydroxyethyl, propyl, butyl, secondary butyl, tert-butyl, cyclopropyl, 4-chlorobutyl, cyclobutyl, 4-nitroamyl, hexyl, cyclohexyl, octyl, decyl, octadecyl, benzyl, phenethyl, etc.

The nature of the Ballast group in the above formulas is not critical, as long as it confers nondiffusibility to the compound, and as long as it is not a disubstituted carbamoyl group. Typical Ballast groups include long-chain alkyl radicals linked directly or indirectly to the compound, as well as aromatic radicals of the benzene and naphthalene series indirectly attached or fused directly to the nucleus shown. Useful Ballast groups generally have at least 8 carbon atoms, such as substituted or unsubstituted alkyl groups of 8 to 22 carbon atoms, such as octyl, decyl, 4-chlorooctadecyl, etc; a carbamoyl radical having 8 to 30 carbon atoms, such as —CONH(CH$_2$)$_4$—O—C$_6$H$_3$(C$_5$H$_{11}$)$_2$; a keto radical having 8 to 30 carbon atoms, such as —CO—C$_{17}$H$_{35}$ or —CO—C$_6$H$_4$(t-C$_{12}$H$_{25}$), etc.

In the above formulas, $R_2$ and $R_3$ can each be an alicyclic group, such as cycloalkyl of 4 to 22 carbon atoms, e.g., cyclopropyl, cyclohexyl, cyclodecyl or cyclooctadecyl; an aliphatic group, such as a straight or branched chain alkyl group of 1 to 30 carbon atoms, including aralkyl and aryloxyalkyl, e.g., methyl, ethyl, butyl, octyl, pentyl, dodecyl, pentadecyl, octadecyl, benzyl, or phenoxypropyl; or an aromatic group, such as aryl of 6 to 22 carbon atoms, including alkaryl and alkoxyaryl, e.g., phenyl, naphthyl, methylphenyl or butoxyphenyl. In a particularly preferred embodiment of this invention, $R_2$ and $R_3$ are each straight chain alkyl groups of 1 to 30 carbon atoms, with the proviso that the total number of carbon atoms is from about 8 to about 50.

As described previously, Z in the above formulas represents the atoms necessary to complete a one-, two- or three-ringed carbocyclic or heterocyclic group containing 5 to 7 nuclear atoms in each ring. For example, Z may be benzene, naphthalene, anthracene, pyrazolone, pyridine, quinoline, pyrimidine, coumarin, indole, indene, pyrazolotriazole, pyrazolobenzimidazole, and the like.

As described previously, Col in the above formulas represents a dye or dye precursor moiety. Dye moieties are well known to those skilled in the art and include, for example, azo, azomethine, azopyrazolone, indoaniline, indophenol, anthraquinone, triarylmethane, alizarin, merocyanine, nitro, quinoline, cyanine, indigoide, phthalocyanine, metal complexed dyes, metallizable dyes, etc. Dye precursor moieties are also well known to those skilled in the art and include, for example, leuco dyes; shifted dyes, which shift hypsochromically or bathochromically when subjected to a different environment, such as a change in pH or reaction with a material to form a complex; coupler moieties, such as a phenol, naphthol, indazolone, open-chain benzoyl acetanilide, pivalylacetanilide, malonamide, malonanilide, cyanoacetyl, coumarin, pyrazolone, etc.

These dye or dye precursor moieties may contain solubilizing groups, if desired, to aid in transfer of the dye. Dye precursor moieties can be converted to dyes by means well known to those skilled in the art, e.g., hydrolysis or oxidation, either in the photosensitive element, in the processing composition or in the dye image-receiving layer to form a visible dye. Preferred dyes and dye precursors are described in U.S. Pat. No. 4,142,891 of Baigrie et al, issued March 6, 1979, which discloses metallizable dyes, U.S. Pat. No. 3,880,658 of Lestina et al, U.S. Pat. No. 3,931,144 of Eldredge et al, U.S. Pat. No. 3,932,380 of Krutak et al, U.S. Pat. No. 3,932,381 of Haase et al and U.S. Pat. No. 3,942,987 of Landholm et al, the disclosures of which are hereby incorporated by reference. As used hereinafter, unless the context indicates otherwise, the term "dye" includes dye precursors, it being understood that the dye precursor is converted to the desired dye to form the final image.

In addition to the Ballast groups described above, the Z and Y nuclei described above may also have groups or atoms attached thereto, such as the halogens, alkyl, aryl, alkoxy, aryloxy, nitro, amino, alkylamino, arylamino, amido, cyano, alkylmercapto, keto, carboalkoxy, heterocyclic groups, etc.

For specific examples of the less reactive, ballasted nondiffusible compound described above which has a color-providing moiety attached thereto through a sulfonamido group which is alkali-cleavable upon oxidation, reference is made to the following patents, the disclosures of which are hereby incorporated by reference: U.S. Pat. Nos. 4,076,529 of Fleckenstein et al; 3,880,658 of Lestina et al; 3,931,144 of Eldredge et al; 3,932,380 of Krutak et al; 3,932,381 of Haase et al and 3,942,987 of Landholm et al.

For specific examples of the more reactive, nondiffusible compound described above which has a color-providing moiety attached thereto through a sulfonamido group which is alkali-cleavable upon oxidation, and which is ballasted with a N,N-disubstituted carbamoyl group, reference is made to U.S. Pat. No. 4,135,929 of Fernandez et al, issued Jan. 23, 1979, the disclosure of which is hereby incorporated by reference.

A process for producing a photographic image in color according to our invention comprises:

treating an imagewise-exposed photographic element, as described above, with an alkaline processing composition in the presence of a silver halide developing agent to effect development of each exposed silver halide emulsion layer, whereby:

(a) the dye-releasing compounds release a diffusible dye in imagewise distribution as a function of the development of the silver halide emulsion layer; and (b) at least a portion of the imagewise distribution of the dye diffuses out of the element, such as to a dye image-receiving layer.

A process for producing a photographic image in color according to our invention using a preferred element as described above wherein the nondiffusible compounds are ballasted compounds having a color-providing moiety attached thereto through a sulfonamido group which is alkali-cleavable upon oxidation comprises:

treating said element which has been imagewise-exposed with an alkaline processing composition in the presence of a silver halide developing agent to effect development of each exposed silver halide emulsion layer, whereby:

(a) the developing agent becomes oxidized;

(b) the oxidized developing agent cross-oxidizes the sulfonamido compounds;

(c) the oxidized sulfonamido compounds then cleave, thus forming an imagewise distribution of the color-providing moieties as a function of the development of the silver halide emulsion layer; and (d) at least a portion of the imagewise distribution of the color-providing moieties diffuses out of the element, such as to a dye image-receiving layer.

It will be appreciated that, after processing the photographic elements described above, there remains in the elements, after transfer has taken place, an imagewise distribution of dye in addition to developed silver. A color image comprising residual nondiffusible compound may be obtained in these elements if the residual silver and silver halide are removed by any conventional manner well known to those skilled in the photographic art, such as a bleach bath followed by a fix bath, a bleach-fix bath, etc. The imagewise distribution of dye may also diffuse out of these elements into these baths, if desired, rather than to an image-receiving element.

The photographic element in the above-described processes can be treated with an alkaline processing composition to effect or initiate development in any manner. A preferred method for applying processing composition is by use of a rupturable container or pod which contains the composition. In general, the processing composition employed in this invention contains the developing agent for development, although the composition could also be solely an alkaline solution where the developer is incorporated in the photographic element, the image-receiving element or the process sheet, in which case the alkaline solution serves to activate the incorporated developer.

A photographic film unit which can be processed in accordance with this invention is adapted to be processed by passing the unit between a pair of juxtaposed pressure-applying members, such as would be found in a camera designed for in-camera processing, and comprises:

(1) a photographic element as described above;
(2) a dye image-receiving layer; and
(3) an alkaline processing composition and means for discharging same within the film unit, such as a rupturable container which is adapted to be positioned during processing of the film unit so that a compressive force applied to the container by the pressure-applying members will effect a discharge of the container's contents within the film unit;

the film unit containing a silver halide developing agent.

The dye image-receiving layer in the above-described film unit can be located on a separate support adapted to be superposed on the photographic element after exposure thereof. Such image-receiving elements are generally disclosed, for example, in U.S. Pat. No. 3,362,819. When the means for discharging the processing composition is a rupturable container, it is usually positioned in relation to the photographic element and the image-receiving element so that a compressive force applied to the container by pressure-applying members, such as would be found in a typical camera used for in-camera processing, will effect a discharge of the container's contents between the image-receiving element and the outermost layer of the photographic element. After processing, the dye image-receiving element is separated from the photographic element.

The dye image-receiving layer in the above-described film unit can also be located integral with the photographic element between the support and the lowermost photosensitive silver halide emulsion layer. One useful format for integral receiver-negative photographic elements is disclosed in Belgian Pat. No. 757,960. In such an embodiment, the support for the photographic element is transparent and is coated with an image-receiving layer, a substantially opaque light-reflective layer, e.g., $TiO_2$, and then the photosensitive layer or layers described above. After exposure of the photographic element, a rupturable container containing an alkaline processing composition and an opaque process sheet are brought into superposed position. Pressure-applying members in the camera rupture the container and spread processing composition over the photographic element as the film unit is withdrawn from the camera. The processing composition develops each exposed silver halide emulsion layer, and dye images, formed as a function of development, diffuse to the image-receiving layer to provide a positive, right-reading image which is viewed through the transparent support on the opaque reflecting layer background. For other details concerning the format of this particular integral film unit, reference is made to the above-mentioned Belgian Pat. No. 757,960.

Another format for integral negative-receiver photographic elements in which the present invention can be employed is disclosed in Belgian Pat. No. 757,959. In this embodiment, the support for the photographic element is transparent and is coated with the image-receiving layer, a substantially opaque, light-reflective layer and the photosensitive layer or layers described above. A rupturable container, containing an alkaline processing composition and an opacifier, is positioned between the top layer and a transparent cover sheet which has thereon a neutralizing layer and timing layer. The film unit is placed in a camera, exposed through the transparent cover sheet and then passed through a pair of pressure-applying members in the camera as it is being removed therefrom. The pressure-applying members rupture the container and spread processing composition and opacifier over the negative portion of the film unit to render it light-insensitive. The processing composition develops each silver halide layer and dye images, formed as a result of development, diffuse to the image-receiving layer to provide a positive, right-reading image which is viewed through the transparent support on the opaque reflecting layer background. For further details concerning the format of this particular integral film unit, reference is made to the above-mentioned Belgian Pat. No. 757,959.

Still other useful integral formats in which this invention can be employed are described in U.S. Pat. Nos. 3,415,644; 3,415,645; 3,415,646; 3,647,437; and 3,635,707. In most of these formats, a photosensitive silver halide emulsion is coated on an opaque support, and a dye image-receiving layer is located on a separate transparent support superposed over the layer outermost from the opaque support. In addition, this transparent support also preferably contains a neutralizing layer and a timing layer underneath the dye image-receiving layer.

Another embodiment of the invention uses the image-reversing technique disclosed in British Patent 904,364, page 19, lines 1 through 41. In this process, the dye-releasing compounds are used in combination with physical development nuclei in a nuclei layer contiguous to the photosensitive silver halide negative emulsion layer. The film unit contains a silver halide solvent, preferably in a rupturable container with the alkaline processing composition.

The film unit or assembly used in the present invention may be used to produce positive images in single- or multicolors. In a three-color system, at least one silver halide emulsion layer of the film assembly will have associated therewith the two dye-releasing compounds described above which releases a dye possessing a predominant spectral absorption within the region of the visible spectrum to which said silver halide emulsion is sensitive, i.e., the blue-sensitive silver halide emulsion layer will have yellow or yellow-forming dye-releasers associated therewith, the green-sensitive silver halide emulsion layer will have magenta or magenta-forming dye-releasers associated therewith, and the red-sensitive silver halide emulsion layer will have cyan or cyan-forming dye-releasers associated therewith. Each of the two dye moieties released from the compounds associated with a given silver halide emulsion layer should have substantially the same hue. The dye-releasers associated with each silver halide emulsion layer may be contained either in the silver halide emulsion layer itself or in a layer or layers contiguous to the silver halide emulsion layer, i.e., each dye-releaser may be coated in a separate layer underneath the silver halide emulsion layer with respect to the exposure direction.

The concentration of the dye-releasing compounds that are employed in the present invention may be varied over a wide range, depending upon the particular compound employed and the results desired. For example, the dye-releasers of the present invention may be coated in layers by using coating solutions containing between about 0.5 and about 8 percent by weight of the dye-releaser distributed in a hydrophilic film-forming natural material or synthetic polymer, such as gelatin, polyvinyl alcohol, etc, which is adapted to be permeated by aqueous alkaline processing composition.

A variety of silver halide developing agents can be employed in this invention, as long as it cross-oxidizes with the dye-releasers described therein. The developer may be employed in the photosensitive element to be activated by the alkaline processing composition. Specific examples of developers which can be employed in this invention include:

N-methylaminophenol
Phenidone (1-phenyl-3-pyrazolidone)
Dimezone (1-phenyl-4,4-dimethyl-3-pyrazolidone)
aminophenols
1-phenyl-4-methyl-4-hydroxymethyl-3-pyrazolidone
N,N-diethyl-p-phenylenediamine
N,N,N',N'-tetramethyl-p-phenylenediamine
3-methyl-N,N-diethyl-p-phenylenediamine
3-methoxy-N-ethyl-N-ethoxy-p-phenylenediamine, etc.

The non-chromogenic developers in this list are preferred, however, since they avoid any propensity of staining the dye image-receiving layer.

In using the dye-releasing compounds according to the invention which produce diffusible dye images as a function of development, either conventional negative-working or direct-positive silver halide emulsions may be employed. If the silver halide emulsion employed is a direct-positive silver halide emulsion, such as an internal-image emulsion designed for use in the internal image reversal process, or a fogged, direct-positive emulsion such as a solarizing emulsion, which is developable in unexposed areas, a positive image can be obtained in certain embodiments on the dye image-receiving layer. After exposure of the film unit, the alkaline processing composition permeates the various layers to initiate development of the exposed photosensitive silver halide emulsion layers. The developing agent present in the film unit develops each of the silver halide emulsion layers in the unexposed areas (since the silver halide emulsions are direct-positive ones), thus causing the developing agent to become oxidized imagewise corresponding to the unexposed areas of the direct-positive silver halide emulsion layers. The oxidized developing agent then cross-oxidizes the dye-releasing compounds and the oxidized form of the compounds then undergoes a base-catalyzed reaction to release the dyes imagewise as a function of the imagewise exposure of each of the silver halide emulsion layers. At least a portion of the imagewise distributions of diffusible dyes diffuse to the image-receiving layer to form a positive image of the original subject. After being contacted by the alkaline processing composition, a pH-lowering layer in the film unit or image-receiving unit lowers the pH of the film unit or image receiver to stabilize the image.

Internal-image silver halide emulsions useful in this invention are described more fully in the November 1976 edition of Research Disclosure, pages 76 through 79, the disclosure of which is hereby incorporated by reference.

The various silver halide emulsion layers of a color film assembly employed in this invention can be disposed in the usual order, i.e., the blue-sensitive silver halide emulsion layer first with respect to the exposure side, followed by the green-sensitive and red-sensitive silver halide emulsion layers. If desired, a yellow dye layer or a yellow colloidal silver layer can be present between the blue-sensitive and green-sensitive silver halide emulsion layers for absorbing or filtering blue radiation that may be transmitted through the blue-sensitive layer. If desired, the selectively sensitized silver halide emulsion layers can be disposed in a different order, e.g., the blue-sensitive layer first with respect to the exposure side, followed by the red-sensitive and green-sensitive layers.

The rupturable container employed in certain embodiments of this invention can be of the type disclosed in U.S. Pat. Nos. 2,543,181; 2,643,886; 2,653,732; 2,723,051; 3,056,492; 3,056,491 and 3,152,515. In general, such containers comprise a rectangular sheet of fluid- and air-impervious material folded longitudinally upon itself to form two walls which are sealed to one another along their longitudinal and end margins to form a cavity in which processing solution is contained.

Generally speaking, except where noted otherwise, the silver halide emulsion layers employed in the invention comprise photosensitive silver halide dispersed in gelatin and are about 0.6 to 6 microns in thickness; the dye-releasers are dispersed in an aqueous alkaline solution-permeable polymeric binder, such as gelatin, as a separate layer about 0.2 to 7 microns in thickness; and the alkaline solution-permeable polymeric interlayers, e.g., gelatin, are about 0.2 to 5 microns in thickness. Of course, these thicknesses are approximate only and can be modified according to the product desired.

Scavengers for oxidized developing agent can be employed in various interlayers of the photographic elements of the invention. Suitable materials are disclosed on page 83 of the November 1976 edition of Research Disclosure, the disclosure of which is hereby incorporated by reference.

Any material can be employed as the image-receiving layer in this invention as long as the desired function of mordanting or otherwise fixing the dye images is obtained. The particular material chosen will, of course, depend upon the dye to be mordanted. Suitable materials are disclosed on pages 80 through 82 of the November 1976 edition of Research Disclosure, the disclosure of which is hereby incorporated by reference.

Use of a pH-lowering material in the film units employed in this invention will usually increase the stability of the transferred image. Generally, the pH-lowering material will effect a reduction in the pH of the image layer from about 13 or 14 to at least 11 and preferably 5 to 8 within a short time after imbibition. Suitable materials and their functions are disclosed on pages 22 and 23 of the July 1974 edition of Research Disclosure, and pages 35 through 37 of the July 1975 edition of Research Disclosure, the disclosures of which are hereby incorporated by reference.

A timing or inert spacer layer can be employed in the practice of this invention over the pH-lowering layer which "times" or controls the pH reduction as a function of the rate at which the alkaline composition diffuses through the inert spacer layer. Examples of such timing layers and their functions are disclosed in the Research Disclosure articles mentioned in the paragraph above concerning pH-lowering layers.

The alkaline processing composition employed in this invention is the conventional aqueous solution of an alkaline material, e.g., alkali metal hydroxides or carbonates such as sodium hydroxide, sodium carbonate or an amine such as diethylamine, preferably possessing a pH in excess of 11, and preferably containing a developing agent as described previously. Suitable materials and addenda frequently added to such compositions are disclosed on pages 79 and 80 of the November 1976 edition of Research Disclosure, the disclosure of which is hereby incorporated by reference.

While the alkaline processing composition used in this invention can be employed in a rupturable container, as described previously, to conveniently facilitate the introduction of processing composition into the film unit, other methods of inserting processing composition into the film unit could also be employed, e.g., interjecting processing solution with communicating members similar to hypodermic syringes which are attached either to a camera or camera cartridge. The processing composition may also be applied by means of a swab or by dipping in a bath, if so desired.

The alkaline solution-permeable, substantially opaque, light-reflective layer employed in certain embodiments of photographic film units used in this invention are described more fully in the November 1976 edition of Research Disclosure, page 82, the disclosure of which is hereby incorporated by reference.

The supports for the photographic elements used in this invention can be any material, as long as it does not deleteriously affect the photographic properties of the film unit and is dimensionally stable. Typical flexible sheet materials are described on page 85 of the November 1976 edition of Research Disclosure, the disclosure of which is hereby incorporated by reference.

While the invention has been described with reference to layers of silver halide emulsions and dye image-providing materials, dotwise coating, such as would be obtained using a gravure printing technique, could also be employed. In this technique, small dots of blue-, green- and red-sensitive emulsions have associated therewith, respectively, dots of yellow, magenta and cyan color-providing substances. After development, the transferred dyes would tend to fuse together into a continuous tone.

The silver halide emulsions useful in this invention, both negative-working and direct-positive ones, are well known to those skilled in the art and are described in Product Licensing Index, Volume 92, December 1971, publication 9232, page 107, paragraph I, "Emulsion types"; they may be chemically and spectrally sensitized as described on page 107, paragraph III, "Chemical sensitization", and pages 108 and 109, paragraph XV, "Spectral sensitization", of the above article; they can be protected against the production of fog and can be stabilized against loss of sensitivity during keeping by employing the materials described on page 107, paragraph V, "Antifoggants and stabilizers", of the above article; they can contain development modifiers, hardeners, and coating aids as described on pages 107 and 108, paragraph IV, "Development modifiers"; paragraph VII, "Hardeners"; and paragraph XII, "Coating aids", of the above article; they and other layers in the photographic elements used in this invention can contain plasticizers, vehicles and filter dyes described on page 108, paragraph XI, "Plasticizers and lubricants", and paragraph VIII, "Vehicles", and page 109, paragraph XVI, "Absorbing and filter dyes", of the above article; they and other layers in the photographic elements used in this invention may contain addenda which are incorporated by using the procedures described on page 109, paragraph XVII, "Methods of addition", of the above article; and they can be coated by using the various techniques described on page 109, paragraph XVIII, "Coating procedures", of the above article, the disclosures of which are hereby incorporated by reference.

The term "nondiffusing" used herein has the meaning commonly applied to the term in photography and denotes materials that for all practical purposes do not migrate or wander through organic colloid layers, such as gelatin, in the photographic elements of the invention in an alkaline medium and preferably when processed in a medium having a pH of 11 or greater. The same meaning is to be attached to the term "immobile". The term "diffusible" as applied to the materials of this invention has the converse meaning and denotes materials having the property of diffusing effectively through the colloid layers of the photographic elements in an alkaline medium. "Mobile" has the same meaning as "diffusible".

The term "associated therewith" as used herein is intended to mean that the materials can be in either the same or different layers so long as the materials are accessible to one another.

The following examples are provided to further illustrate the invention.

EXAMPLE 1

Preparation and Photographic Testing of Integral Imaging Receiving Element

Photographic elements were prepared by coating the following layers in the order recited on a transparent poly(ethylene terephthalate) film support. Quantities are parenthetically given in g/m$^2$, unless otherwise stated.

(1) image-receiving layer of a poly[styrene-co-N-benzyl-N,N-di-methyl-N-vinylbenzyl-co-divinylbenzene] latex mordant (2.16) and gelatin (2.16);

(2) reflecting layer of titanium dioxide (21.6) and gelatin (3.24);

(3) opaque layer of carbon black (2.7) and gelatin (1.72);

(4) cyan dye-providing layer of gelatin (1.2) and the cyan dye-releasers described in Table II and in the amounts identified in Table I, the dye-releasers being dissolved in one-half their weight of diethyl lauramide;

(5) red-sensitive, direct-positive silver bromide emulsion (silver-1.30), gelatin (1.35), 1-[4-(2-formylhydrazine)phenyl]-3-methylthiourea (2.91 mg/mole of silver), aceto-2-{p-[5-amino-2-(2,4-di-t-pentylphenoxy)benzamido]phenyl}hydrazide (29.13 mg/mole of silver);

(6) interlayer of gelatin (1.62) and 2,5-di-sec-dodecylhydroquinone (1.30);

(7) magenta dye-providing compound C identified in Table II (0.54) dissolved in diethyl lauramide (0.27) and dispersed in gelatin (1.22);

(8) green-sensitive, direct-positive silver bromide emulsion (silver-1.30), gelatin (1.35), 1-[4-(2-formylhydrazine)phenyl]-3-methylthiourea (4.29 mg/mole of silver), aceto-2-{p-[5-amino-2-(2,4-di-t-pentylphenoxy)benzamido]phenyl}hydrazide (176 mg/mole of silver), 1-(N-dodecylcarbamoyl)-5,6-dichlorobenzotriazole (0.054);

(9) interlayer of gelatin (1.62) and 2,5-di-sec-dodecylhydroquinone (1.30);

(10) yellow dye-providing compound D identified in Table II (0.65) dissolved in diethyl lauramide (0.32) and dispersed in gelatin (1.46);

(11) blue-sensitive, direct-positive silver bromide emulsion (silver-1.35), gelatin (1.24), 1-[4-(2-formylhydrazine)phenyl]-3-methylthiourea (2.53 mg/mole of silver), aceto-2-{p-[5-amino-2-(2,4-di-t-pentylphenoxy)benzamido]phenyl}hydrazide (88 mg/mole of silver); and

(12) overcoat layer of gelatin (0.89).

Samples of the above-prepared photosensitive elements were exposed through a multicolor graduated-density test object. The exposed samples were then processed at 72° F. (22° C.) by rupturing a pod containing a viscous processing composition between the photosensitive element and a transparent cover sheet, as described below.

The processing composition was as follows:

| | |
|---|---|
| Potassium hydroxide | 46.8 g |
| Sodium sulfite | 1.0 g |
| 5-Methylbenzotriazole | 3.8 g |
| 4-Hydroxymethyl-4-methyl-1-phenyl-3-pyrazolidone | 12.0 g |
| Potassium fluoride | 10.0 g |
| Carbon dispersion | 172.0 g Carbon |
| Carboxymethyl cellulose | 44.0 g |
| Water to 1.0 liter | |

The cover sheet consisted of a transparent poly(ethylene terephthalate) film support having coated thereon:

(1) a polyacrylic acid layer (17.5 meq/0.093 $m^2$)

(2) a timing layer comprising 200 mg/0.093 $m^2$ of a mixture of 89 percent cellulose acetate (40 percent acetyl) and 11 percent poly(styrene-co-maleic anhydride) (approximately 50 percent hydrolyzed)

(3) a second timing layer comprising 200 mg/0.093 $m^2$ of a latex dispersion of poly(acrylonitrile-co-vinylidene chloride-co-acrylic acid Conventional density versus Log E curves were then obtained for the above photographic elements after processing. From the curves, the difference in Log Exposure (ΔLog E) was measured for density values of 0.6 and 0.3 (i.e., the lower part of the scale). Higher ΔLog E numbers are an indication of lower contrast which is desirable.

The following results were obtained:

TABLE I

| Element | Cyan Dye-Releaser (mg/ft²) A | B | Lower Scale Δ Log E |
|---|---|---|---|
| (1) Control | 592 | 0 | 0.21 |
| (2) | 549 | 43 | 0.30 |

The above results indicate that a relatively small amount of a dye-releaser with a N,N-disubstituted carbamoyl ballast group provides a significant decrease in lower scale contrast.

TABLE II

Cyan Dye-Releasing Compound A

TABLE II-continued

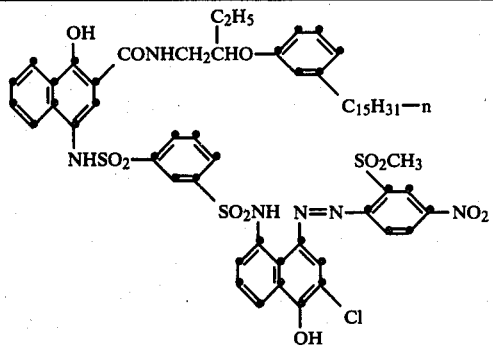

Cyan Dye-Releasing Compound B

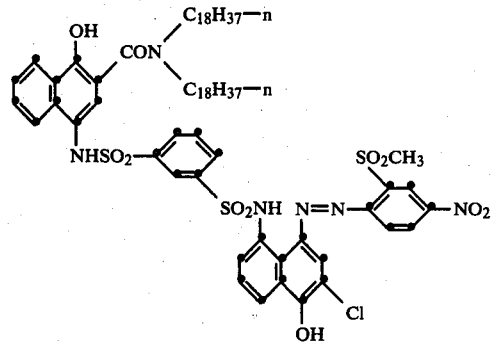

Magenta Dye-Releasing Compound C

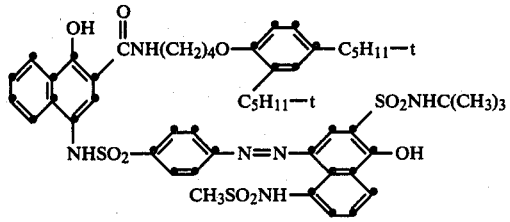

Yellow Dye-Releasing Compound D

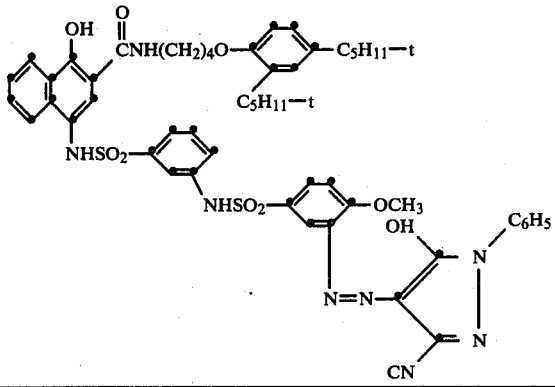

EXAMPLE 2

Combinations of Yellow and Magenta Dye-Releasers

Two integral imaging receiver elements were prepared. Element 3 was a control and contained yellow dye-releaser D and magenta dye-releaser C. Element 4 contained a dye-releaser combination according to the invention in both the yellow dye-providing layer and the magenta dye-providing layer.

The elements were prepared in the same manner as in Example 1, except that the yellow and magenta dye-releasing compounds differed as described in Table IV.

Samples of each element were exposed through a graduated-density, multicolor test object such that selectively filtered light was focused on separate portions of each sample.

The exposed samples were processed as described in Example 1 and sensitometric curves (transferred dye density versus exposure) were obtained in the same manner. The lower scale Δ Log E was determined, as described in Example 1, from the sensitometric curves representing the blue exposure and green exposure, respectively, and is recorded as follows:

TABLE III

| Element | Yellow Dye-Releaser (mg/m²) D | E | Lower Scale Δ Log E (Blue Exp.) | Magenta Dye-Releaser (mg/m²) C | F | Lower Scale Δ Log E (Green Exp.) |
|---|---|---|---|---|---|---|
| 3 | 646 | 0 | 0.38 | 538 | 0 | 0.47 |
| 4 | 592 | 54 | 0.45 | 506 | 32 | 0.66 |

As before, the above results indicate that use of a combination of dye releasers in accordance with our invention will provide a significant decrease in lower scale contrast.

TABLE IV

Yellow Dye-Releasing Compound E

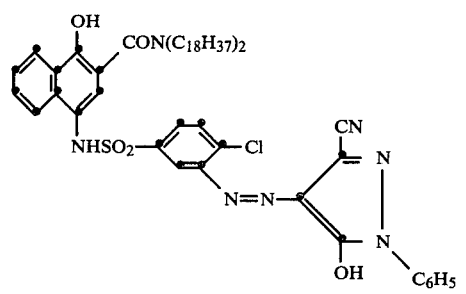

Magenta Dye-Releasing Compound F

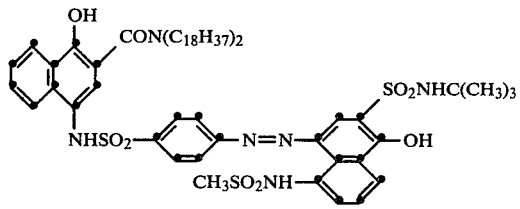

EXAMPLE 3

Concentration Series

A series of single color, integral imaging receiver elements were prepared by coating a transparent poly(ethylene terephthalate) film support with the following layers in the order recited. Quantities are parenthetically given in g/m², unless otherwise stated.

(1) image-receiving layer of a poly(styrene-co-N-benzyl-N,N-dimethyl-N-vinylbenzyl-co-divinyl benzene) latex mordant (2.16) and gelatin (2.16);

(2) reflecting layer of titanium dioxide (21.6) and gelatin (3.24);

(3) opaque layer of carbon black (2.7) and gelatin (1.72);

(4) cyan dye-providing layer of gelatin (1.35) and the cyan dye-releasing compounds in various amounts as identified in Table V;

(5) red-sensitive, direct-positive, silver bromide emulsion (silver-1.35), gelatin (1.35), 1-[4-(2-formylhydrazino)phenyl]-3-methylthiourea (2.6 mg/mole of silver), aceto-2-{p-[5-amino-2-(2,4-di-t-pentylphenoxy)-benzamido]-phenyl}hydrazide (26 mg/mole of silver), 5-sec-octadecyl-hydroquinone-2-sulfonic acid (16 g/mole of silver); and (6) overcoat layer of gelatin (1.62).

Samples of each element were exposed and processed as described in Example 1 and the following results were obtained:

TABLE V

| Element | Cyan Dye-Releaser (mg/m²) A | B | Mole Percent of B | Cyan Dye Density $D_{min}$ | $D_{max}$ | Lower Scale Δ Log E |
|---|---|---|---|---|---|---|
| 5 | 592 | 0 | 0 | 0.16 | 1.94 | 0.17 |
| 6 | 549 | 48 | 7 | 0.16 | 2.02 | 0.22 |
| 7 | 420 | 194 | 29 | 0.17 | 2.10 | 0.21 |
| 8 | 296 | 332 | 50 | 0.18 | 2.14 | 0.25 |
| 9 | 0 | 665 | 100 | 0.20 | 2.20 | 0.33 |

The above results indicate that use of a combination of dye releasers in accordance with our invention provides a tool for decreasing lower scale contrast to any preselected value between the range of values given.

The invention has been described in detail with particular reference to preferred embodiments thereof, but it will be understood that variations and modifications can be effected within the spirit and scope of the invention.

What is claimed is:

1. A photographic element comprising a support having thereon at least one photosensitive silver halide emulsion layer, said emulsion layer having associated therewith two nondiffusible redox dye-releasing or dye precursor-releasing compounds capable of releasing diffusible dyes or dye precursors, said compounds having different relative reactivities, the reactivity of the compound which is more reactive being at least 1.5 times the reactivity of the compound which is less reactive.

2. The photographic element of claim 1 wherein each said nondiffusible compound is a ballasted compound having said dye or dye precursor moiety attached thereto through a sulfonamido group which is alkali-cleavable upon oxidation.

3. The photographic element of claim 2 wherein the ballast group which is attached to said more reactive compound is a N,N-disubstituted carbamoyl ballast group.

4. The photographic element of claim 2 wherein said less reactive compound has the following formula:

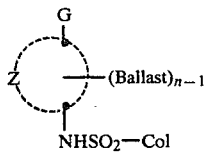

and said more reactive compound has the following formula:

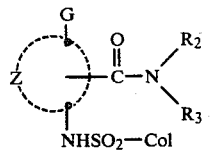

wherein:

(a) each Col is a dye or dye precursor moiety;

(b) each G is —OR or —NHR$_1$, wherein R is hydrogen or a hydrolyzable moiety, and R$_1$ is hydrogen, an alkyl group of 1 to 22 carbon atoms or a —SO$_2$-Col moiety;

(c) Ballast is an organic ballasting radical of such molecular size and configuration as to render said compound nondiffusible during development in an alkaline processing composition;

(d) n is a positive integer of 1 to 2, and is 2 when G is OR or when R$_1$ is hydrogen, an alkyl group of less than 8 carbon atoms, or —SO$_2$Col;

(e) R$_2$ and R$_3$ each represents an aliphatic, alicyclic or aromatic group, at least one of which or the combination thereof being of such size and configuration as to render said compound nondiffusible during development in an alkaline processing composition;

(f) each Z represents the atoms necessary to complete a one-, two- or three-ringed carbocyclic or heterocyclic group containing 5 to 7 nuclear atoms in each ring; and (g) each —NHSO$_2$—Col group being joined to a position on Z so as to be conjugated to G.

5. The photographic element of claim 1 wherein each of said nondiffusible compounds is a sulfonamidophenol, a sulfonamidonaphthol or a sulfonamidoaniline.

6. The photographic element of claim 1 wherein each silver halide emulsion is a direct-positive silver halide emulsion.

7. The photographic element of claim 2 wherein said less reactive compound has the following formula:

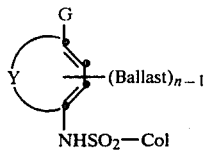

and said more reactive compound has the following formula:

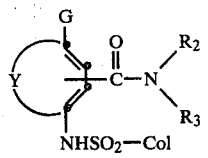

wherein:

(a) each Col is a dye or dye precursor moiety;

(b) each G is —OR or —NHR$_1$, wherein R is hydrogen or a hydrolyzable moiety, and R$_1$ is hydrogen, an alkyl group of 1 to 22 carbon atoms or a —SO$_2$-Col moiety;

(c) Ballast is an organic ballasting radical of such molecular size and configuration as to render said compound nondiffusible during development in an alkaline processing composition;

(d) n is a positive integer of 1 to 2, and is 2 when G is OR or when R$_1$ is hydrogen, an alkyl group of less than 8 carbon atoms, or —SO$_2$Col;

(e) R$_2$ and R$_3$ each represents an aliphatic, alicyclic or aromatic group, at least one of which or the combination thereof being of such size and configuration as to render said compound nondiffusible during development in an alkaline processing composition; and (f) each Y represents the atoms necessary to complete a benzene nucleus, a naphthalene nucleus or a 5- to 7-membered heterocyclic ring.

8. The photographic element of claim 7 wherein:

(a) each G is OH;

(b) n is 2;

(c) each Y is a naphthalene nucleus;

(d) R$_2$ and R$_3$ are each straight chain alkyl groups of 1 to 30 carbon atoms, with the proviso that the total number of carbon atoms is from about 8 to about 50; and (e) the carbamoyl ballast group in said more reactive compound is located ortho to G.

9. In a photographic element comprising a support having thereon a red-sensitive silver halide emulsion layer having associated therewith a first ballasted, nondiffusible, redox, cyan dye-releasing or dye precursor-releasing compound capable of releasing a diffusible cyan dye or dye precursor, a green-sensitive silver halide emulsion layer having associated therewith a first ballasted, nondiffusible, redox, magenta dye-releasing or dye precursor-releasing compound capable of releasing a diffusible magenta dye or dye precursor, and a blue-sensitive silver halide emulsion layer having associated therewith a first ballasted, nondiffusible, redox, yellow dye-releasing or dye precursor-releasing compound capable of releasing a diffusible yellow dye or dye precursor, the improvement wherein at least one of said silver halide emulsion layers has associated therewith a second ballasted, nondiffusible, redox, dye-releasing or dye precursor-releasing compound capable of releasing a diffusible dye or dye precursor, said dye or dye precursor moiety attached to said second compound having substantially the same hue as the dye or dye precursor moiety attached to said first compound, and wherein said second compound has a different relative reactivity than said first compound, the reactivity of the compound which is more reactive being at least 1.5 times the reactivity of the compound which is less reactive.

10. The photographic element of claim 9 wherein each said ballasted compound has said dye or dye precursor moiety attached thereto through a sulfonamido group which is alkali-cleavable upon oxidation.

11. The photographic element of claim 10 wherein the ballast group which is attached to said more reactive compound is a N,N-disubstituted carbamoyl ballast group.

12. The photographic element of claim 10 wherein each said less reactive compound has the following formula:

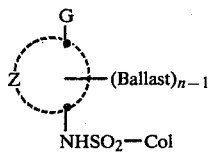

and each said more reactive compound has the following formula:

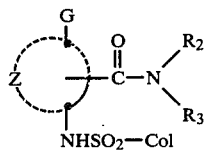

wherein:

(a) each Col is a dye or dye precursor moiety;

(b) each G is —OR or —NHR$_1$, wherein R is hydrogen or a hydrolyzable moiety, and R$_1$ is hydrogen, an alkyl group of 1 to 22 carbon atoms or a —SO$_2$-Col moiety;

(c) Ballast is an organic ballasting radical of such molecular size and configuration as to render said compound nondiffusible during development in an alkaline processing composition;

(d) n is a positive integer of 1 to 2, and is 2 when G is OR or when R$_1$ is hydrogen, an alkyl group of less than 8 carbon atoms, or —SO$_2$Col;

(e) R$_2$ and R$_3$ each represents an aliphatic, alicyclic or aromatic group, at least one of which or the combination thereof being of such size and configuration as to render said compound nondiffusible during development in an alkaline processing composition;

(f) each Z represents the atoms necessary to complete a one-, two- or three-ringed carbocyclic or heterocyclic group containing 5 to 7 nuclear atoms in each ring; and (g) each —NHSO$_2$—Col group being joined to a position on Z so as to be conjugated to G.

13. The photographic element of claim 10 wherein each said less reactive compound has the following formula:

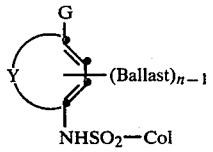

and each said more reactive compound has the following formula:

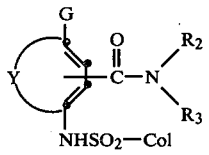

wherein:

(a) each Col is a dye or dye precursor moiety;

(b) each G is —OR or —NHR$_1$, wherein R is hydrogen or a hydrolyzable moiety, and R$_1$ is hydrogen, an alkyl group of 1 to 22 carbon atoms or a —SO$_2$-Col moiety;

(c) Ballast is an organic ballasting radical of such molecular size and configuration as to render said compound nondiffusible during development in an alkaline processing composition;

(d) n is a positive integer of 1 to 2, and is 2 when G is OR or when R$_1$ is hydrogen, an alkyl group of less than 8 carbon atoms, or —SO$_2$Col;

(e) R$_2$ and R$_3$ each represents an aliphatic, alicyclic or aromatic group, at least one of which or the combination thereof being of such size and configuration as to render said compound nondiffusible during development in an alkaline processing composition; and (f) each Y represents the atoms necessary to complete a benzene nucleus, a naphthalene nucleus or a 5- to 7-membered heterocyclic ring.

14. In a photographic assemblage comprising:

(a) a support having thereon at least one photosensitive silver halide emulsion layer having associated therewith a first ballasted, nondiffusible, redox, dye-releasing or dye precursor-releasing compound capable of releasing a diffusible dye or dye precursor;

(b) a dye image-receiving layer; and (c) an alkaline processing composition and means for discharging same within said assemblage;

said assemblage containing a silver halide developing agent; the improvement wherein said silver halide emulsion layer has associated therewith a second ballasted, nondiffusible, redox, dye-releasing or dye precursor-releasing compound capable of releasing a diffusible dye or dye precursor, said second compound having a different relative reactivity than said first compound, the reactivity of the compound which is more-reactive being at least 1.5 times the reactivity of the compound which is less-reactive.

15. The photographic assemblage of claim 14 wherein each said ballasted compound has said dye or dye precursor moiety attached thereto through a sulfonamido group which is alkali-cleavable upon oxidation.

16. The photographic assemblage of claim 15 wherein the ballast group which is attached to said more reactive compound is a N,N-disubstituted carbamoyl ballast group.

17. The photographic assemblage of claim 15 wherein said less reactive compound has the following formula:

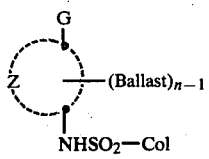

and said more reactive compound has the following formula:

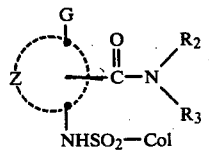

wherein:

(a) each Col is a dye or dye precursor moiety;

(b) each G is —OR or —$NHR_1$, wherein R is hydrogen or a hydrolyzable moiety, and $R_1$ is hydrogen, an alkyl group of 1 to 22 carbon atoms or a —$SO_2$-Col moiety;

(c) Ballast is an organic ballasting radical of such molecular size and configuration as to render said compound nondiffusible during development in an alkaline processing composition;

(d) n is a positive integer of 1 to 2, and is 2 when G is OR or when $R_1$ is hydrogen, an alkyl group of less than 8 carbon atoms, or —$SO_2$Col;

(e) $R_2$ and $R_3$ each represents an aliphatic, alicyclic or aromatic group, at least one of which or the combination thereof being of such size and configuration as to render said compound nondiffusible during development in an alkaline processing composition;

(f) each Z represents the atoms necessary to complete a one-, two- or three-ringed carbocyclic or heterocyclic group containing 5 to 7 nuclear atoms in each ring; and (g) each —$NHSO_2$—Col group being joined to a position on Z so as to be conjugated to G.

18. The photographic assemblage of claim 15 wherein said less reactive compound has the following formula:

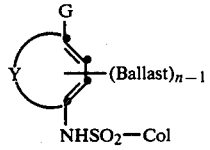

and said more reactive compound has the following formula:

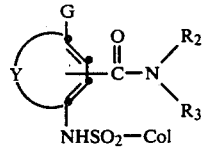

wherein:

(a) each Col is a dye or dye precursor moiety;

(b) each G is —OR or —$NHR_1$, wherein R is hydrogen or a hydrolyzable moiety, and $R_1$ is hydrogen, an alkyl group of 1 to 22 carbon atoms or a —$SO_2$-Col moiety;

(c) Ballast is an organic ballasting radical of such molecular size and configuration as to render said compound nondiffusible during development in an alkaline processing composition;

(d) n is a positive integer of 1 to 2, and is 2 when G is OR or when $R_1$ is hydrogen, an alkyl group of less than 8 carbon atoms, or —$SO_2$Col;

(e) $R_2$ and $R_3$ each represents an aliphatic, alicyclic or aromatic group, at least one of which or the combination thereof being of such size and configuration as to render said compound nondiffusible during development in an alkaline processing composition; and (f) each Y represents the atoms necessary to complete a benzene nucleus, a naphthalene nucleus or a 5- to 7-membered heterocyclic ring.

19. The photographic assemblage of claim 18 wherein:

(a) each G is OH;

(b) n is 2;

(c) each Y is a naphthalene nucleus;

(d) $R_2$ and $R_3$ are each straight chain alkyl groups of 1 to 30 carbon atoms, with the proviso that the total number of carbon atoms is from about 8 to about 50; and (e) the carbamoyl ballast group in said more reactive compound is located ortho to G.

20. In a photographic assemblage comprising:

(a) a support having thereon a red-sensitive silver halide emulsion layer having associated therewith a first ballasted, nondiffusible, redox, cyan dye-releasing or dye precursor-releasing compound capable of releasing a diffusible cyan dye or dye precursor, a green-sensitive silver halide emulsion layer having associated therewith a first ballasted, nondiffusible, redox, magenta dye-releasing or dye precursor-releasing compound capable of releasing a diffusible magenta dye or dye precursor, and a blue-sensitive silver halide emulsion layer having associated therewith a first ballasted, nondiffusible, redox, yellow dye-releasing or dye precursor-releasing compound capable of releasing a diffusible yellow dye or dye precursor;

(b) a dye image-receiving layer; and (c) an alkaline processing composition and means for discharging same within said assemblage; said assemblage containing a silver halide developing agent; the improvement wherein at least one of said silver halide emulsion layers has associated therewith a second ballasted, nondiffusible, redox, dye-releasing or dye precursor-releasing compound capable of releasing a diffusible dye or dye precursor, said dye or dye precursor moiety attached to said second compound having substantially the same hue as the dye or dye precursor moiety attached to said first compound, and wherein said second compound has a different relative reactivity than said first compound, the reactivity of the compound which is more reactive being at least 1.5 times the reactivity of the compound which is less reactive.

21. The photographic assemblage of claim 14 wherein:

(a) said dye image-receiving layer is located between said support and said silver halide emulsion layer; and (b) said assemblage also includes a transparent cover sheet over the layer outermost from said support.

22. The photographic assemblage of claim 21 wherein said cover sheet has thereon, in sequence, a neutralizing layer and a timing layer.

23. The photographic assemblage of claim 22 wherein said discharging means is a rupturable container containing said alkaline processing composition and an opacifying agent, said container being so positioned during processing of said assemblage that a compressive force applied to said container will effect a discharge of the container's contents between said transparent sheet and the layer outermost from said support.

24. The photographic assemblage of claim 14 wherein said support having thereon said photosensitive silver halide emulsion layer is opaque and said dye image-receiving layer is located on a separate transparent support superposed over the layer outermost from said opaque support.

25. The photographic assemblage of claim 24 wherein said transparent support has thereon, in sequence, a neutralizing layer, a timing layer and said dye image-receiving layer.

26. In an integral photographic assemblage comprising:

(a) a photosensitive element comprising a transparent support having thereon the following layers in sequence: a dye image-receiving layer, an alkaline solution-permeable, light-reflective layer, an alkaline solution-permeable, opaque layer, a red-sensitive silver halide emulsion layer having associated therewith a first ballasted, nondiffusible, redox, cyan dye-releasing or dye precursor-releasing compound capable of releasing a diffusible cyan dye or dye precursor, a green-sensitive silver halide emulsion layer having associated therewith a first ballasted, nondiffusible, redox, magenta dye-releasing or dye precursor-releasing compound capable of releasing a diffusible magenta dye or dye precursor, and a blue-sensitive silver halide emulsion having associated therewith a first ballasted, nondiffusible redox, yellow dye-releasing or dye precursor-releasing compound capable of releasing a diffusible yellow dye or dye precursor;

(b) a transparent sheet superposed over said blue-sensitive silver halide emulsion layer and comprising a transparent support having thereon, in sequence, a neutralizing layer and a timing layer; and (c) a rupturable container containing an alkaline processing composition and an opacifying agent which is so positioned during processing of said assemblage that a compressive force applied to said container will effect a discharge of the container's contents between said transparent sheet and said blue-sensitive silver halide emulsion layer; said assemblage containing a silver halide developing agent; the improvement wherein at least one of said silver halide emulsion layers has associated therewith a second ballasted, nondiffusible, redox, dye-releasing or dye precursor-releasing compound capable of releasing a diffusible dye or dye precursor, said dye or dye precursor moiety attached to said second compound having substantially the same hue as the dye or dye precursor moiety attached to said first compound, and wherein said second compound has a different relative reactivity than said first compound, the reactivity of the compound which is more reactive being at least 1.5 times the reactivity of the compound which is less reactive.

27. The photographic assemblage of claim 26 wherein each said ballasted compound has said dye or dye precursor moiety attached thereto through a sulfonamido group which is alkali-cleavable upon oxidation.

28. The photographic assemblage of claim 27 wherein the ballast group which is attached to said more reactive compound is a N,N-disubstituted carbamoyl ballast group.

29. The photographic assemblage of claim 27 wherein said less reactive compound has the following formula:

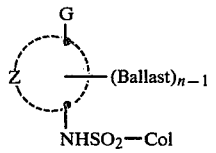

and said more reactive compound has the following formula:

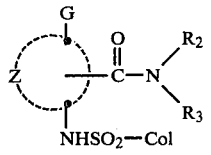

wherein (a) each Col is a dye or dye precursor moiety; p1 (b) each G is —OR or —$NHR_1$, wherein R is hydrogen or a hydrolyzable moiety, and $R_1$ is hydrogen, an alkyl group of 1 to 22 carbon atoms or a —$SO_2$-Col moiety;

(c) Ballast is an inorganic ballasting radical of such molecular size and configuration as to render said compound nondiffusible during development in an alkaline processing composition;

(d) n is a positive integer of 1 to 2, and is 2 when G is OR or when $R_1$ is hydrogen, an alkyl group of less than 8 carbon atoms, or —$SO_2$Col;

(e) $R_2$ and $R_3$ each represents an aliphatic, alicyclic or aromatic group, at least one of which or the combination thereof being of such size and configuration as to render said compound nondiffusible during development in an alkaline processing composition;

(f) each Z represents the atoms necessary to complete a one-, two- or three-ringed carbocyclic or heterocyclic ring containing 5 to 7 nuclear atoms in each ring;

(g) each —$NHSO_2$—Col group being joined to a position on Z so as to be conjugated to G.

30. The photographic assemblage of claim 27 wherein said less reactive compound has the following formula:

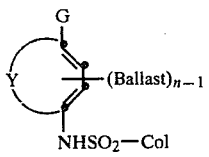

and said more reactive compound has the following formula:

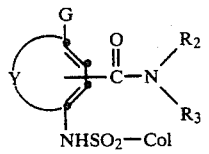

wherein:

(a) each Col is a dye or dye precursor moiety;

(b) each G is —OR or —NHR$_1$, wherein R is hydrogen or a hydrolyzable moiety, and R$_1$ is hydrogen, an alkyl group of 1 to 22 carbon atoms or a —SO$_2$-Col moiety;

(c) Ballast is an organic ballasting radical of such molecular size and configuration as to render said compound nondiffusible during development in an alkaline processing composition;

(d) n is a positive integer of 1 to 2, and is 2 when G is OR or when R$_1$ is hydrogen, an alkyl group of less than 8 carbon atoms, or —SO$_2$Col;

(e) R$_2$ and R$_3$ each represents an aliphatic, alicyclic or aromatic group, at least one of which or the combination thereof being of such size and configuration as to render said compound nondiffusible during development in an alkaline processing composition; and (f) each Y represents the atoms necessary to complete a benzene nucleus, a naphthalene nucleus or a 5- to 7-membered heterocyclic ring.

31. A process for producing a photographic image in color in an imagewise-exposed photographic element comprising a support having thereon at least one photosensitive silver halide emulsion layer, said emulsion layer having associated therewith two nondiffusible redox dye-releasing or dye precursor-releasing compounds having different relative reactivities, the reactivity of the compound which is more reactive being at least 1.5 times the reactivity of the compound which is less reactive, said process comprising:

treating said element with an alkaline processing composition in the presence of a silver halide developing agent to effect development of each exposed silver halide emulsion layer, whereby:

(a) said dye-releasing or dye precursor-releasing compounds release a diffusible dye or dye precursor in an imagewise distribution as a function of said development of said silver halide emulsion layer; and (b) at least a portion of said imagewise distribution of said dye or dye precursor diffuses out of said element.

32. The process of claim 31 wherein said imagewise distribution of said dye or dye precursor diffuses to a dye image-receiving layer.

33. A process for producing a photographic image in color in an imagewise-exposed photographic element comprising a support having thereon at least one photosensitive silver halide emulsion layer, said emulsion layer having associated therewith two nondiffusible redox dye-releasing or dye precursor-releasing compounds having a different relative reactivities, the reactivity of the compound which is more reactive being at least 1.5 times the reactivity of the compound which is less reactive, each said nondiffusible compound being a ballasted compound having a dye or dye precursor moiety attached thereto through a sulfonamido group which is alkali-cleavable upon oxidation, said process comprising:

treating said element with an alkaline processing composition in the presence of a silver halide developing agent to effect development of each exposed silver halide emulsion layer, whereby:

(a) said developing agent becomes oxidized;

(b) said oxidized developing agent cross-oxidizes said sulfonamido compounds;

(c) said oxidized sulfonamido compounds then cleave, thus forming an imagewise distribution of said dye or dye precursor moieties as a function of said development of said silver halide emulsion layer; and (d) at least a portion of said imagewise distribution of said dye or dye precursor moieties diffuses out of said element.

34. The process of claim 33 wherein the ballast group which is attached to said more reactive compound is a N,N-disubstituted carbamoyl ballast group.

35. The process of claim 33 wherein said less reactive compound has the following formula:

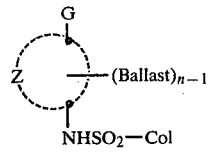

and said more reactive compound has the following formula:

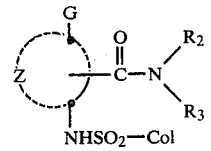

wherein:

(a) each Col is a dye or dye precursor moiety;

(b) each G is —OR or —NHR$_1$, wherein R is hydrogen or a hydrolyzable moiety, and R$_1$ is hydrogen, an alkyl group of 1 to 22 carbon atoms or a —SO$_2$-Col moiety;

(c) Ballast is an organic ballasting radical of such molecular size and configuration as to render said compound nondiffusible during development in an alkaline processing composition;

(d) n is a positive integer of 1 to 2, and is 2 when G is OR or when R$_1$ is hydrogen, an alkyl group of less than 8 carbon atoms, or —SO$_2$Col;

(e) R$_2$ and R$_3$ each represents an aliphatic, alicyclic or aromatic group, at least one of which or the combination thereof being of such size and configuration as to render said compound nondiffusible during development in an alkaline processing composition;

(f) each Z represents the atoms necessary to complete a one-, two- or three-ringed carbocyclic or heterocyclic group containing 5 to 7 nuclear atoms in each ring; and (g) each —$NHSO_2$—Col group being joined to a position on Z so as to be conjugated to G.

36. The process of claim 33 wherein said less reactive compound has the following formula:

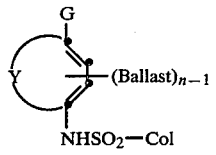

and said more reactive compound has the following formula:

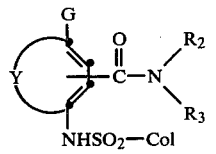

wherein:

(a) each Col is a dye or dye precursor moiety;

(b) each G is —OR or —$NHR_1$, wherein R is hydrogen or a hydrolyzable moiety, and $R_1$ is hydrogen, an alkyl group of 1 to 22 carbon atoms or a —$SO_2$-Col moiety;

(c) Ballast is an organic ballasting radical of such molecular size and configuration as to render said compound nondiffusible during development in an alkaline processing composition;

(d) n is a positive integer of 1 to 2, and is 2 when G is OR or when $R_1$ is hydrogen, an alkyl group of less than 8 carbon atoms, or —$SO_2$Col;

(e) $R_2$ and $R_3$ each represents an aliphatic, alicyclic or aromatic group, at least one of which or the combination thereof being of such size and configuration as to render said compound nondiffusible during development in an alkaine processing composition; and (f) each Y represents the atoms necessary to complete a benzene nucleus, a naphthalene nucleus of a 5- to 7-membered heterocyclic ring.

37. The process of claim 36 wherein:

(a) each G is OH;

(b) n is 2;

(c) each Y is a naphthalene nucleus;

(d) $R_2$ and $R_3$ are each straight chain alkyl groups of 1 to 3 carbon atoms, with the proviso that the total number of carbon atoms is from about 8 to about 50; and (e) the carbamoyl ballast group in said more reactive compound is located ortho to G.

38. The process of claim 31 wherein said photographic element comprises a support having thereon a red-sensitive silver halide emulsion layer having associated therewith a first ballasted, nondiffusible, redox, cyan dye-releasing or dye precursor-releasing compound capable of releasing a diffusible cyan dye or dye precursor, a green-sensitive silver halide emulsion layer having associated therewith a first ballasted, nondiffusible, redox, magenta dye-releasing or dye precursor-releasing compound capable of releasing a diffusible magenta dye or dye precursor, and a blue-sensitive silver halide emulsion layer having associated therewith a first ballasted, nondiffusible, redox, yellow dye-releasing or dye precursor-releasing compound capable of releasing a diffusible yellow dye or dye precursor, and wherein at least one of said silver halide emulsion layers has associated therewith a second ballasted, nondiffusible, redox, dye-releasing or dye precursor-releasing compound, said dye or dye precursor moiety attached to said second compound having substantially the same hue as the dye or dye precursor moiety attached to said first compound, and wherein said second compound has a different relative reactivity than said first compound, the reactivity of the compound which is more-reactive being at least 1.5 times the reactivity of the compound which is less-reactive.

39. In a photosensitive element comprising a support having thereon at least one photosensitive silver halide emulsion layer, said silver halide emulsion layer having, associated therewith, a non-diffusible dye image forming substance capable of being oxidized with an oxidation product of a silver halide developing agent to release a diffusible dye or its precursor at a certain rate under an alkaline condition, the improvement in which said photosensitive silver halide emulsion layer has, associated therewith, another dye image forming substance capable of being oxidized with the oxidation product to release a diffusible dye or its precursor under the alkaline condition at another rate and wherein the ratio of the abovesaid certain rate and the abovesaid another rate is at least 1.5.

* * * * *